US005888090A

United States Patent [19]

Achee

[11] Patent Number: 5,888,090

[45] Date of Patent: Mar. 30, 1999

[54] LIGHTING SYSTEM FOR DECORATIVE MINIATURE HOUSES AND VILLAGE DISPLAYS

[76] Inventor: Jamie S. Achee, 12943 Vigil Jackson Ave., Baton Rouge, La. 70818-2026

[21] Appl. No.: 802,091

[22] Filed: Feb. 19, 1997

[51] Int. Cl.[6] ..... H01R 4/24

[52] U.S. Cl. ..... 439/417; 439/419

[58] Field of Search ..... 439/417, 389, 439/216, 209, 425, 409, 419, 414, 404; 362/806, 249, 391; 446/477, 91

[56] References Cited

U.S. PATENT DOCUMENTS

| | | | |
|---|---|---|---|
| 2,223,222 | 11/1940 | Morrison | 446/91 |
| 3,664,055 | 5/1972 | Bass et al. | 46/45 |
| 4,203,053 | 5/1980 | Shepard | 315/254 |
| 4,462,066 | 7/1984 | Gibson | 362/251 |
| 4,508,399 | 4/1985 | Dowling et al. | 439/67 |
| 4,810,224 | 3/1989 | DeVincent | 446/477 |
| 5,169,355 | 12/1992 | Tammera | 446/477 |
| 5,248,276 | 9/1993 | Deleon | 446/477 |
| 5,445,552 | 8/1995 | Hine | 446/477 |
| 5,498,172 | 3/1996 | Noda | 439/404 |
| 5,601,448 | 2/1997 | Poon | 439/417 |

*Primary Examiner*—Paula Bradley
*Assistant Examiner*—Tho D. Ta
*Attorney, Agent, or Firm*—David L. Ray

[57] ABSTRACT

A lighting system for decorative miniature houses and villages utilizing a transformer powered by 110 V AC and having a direct current output conveyed from the transformer through an electrical cord having two separate electrically conductive wires therein, the electrical cord being connected adjacent to each of the miniature houses or buildings in the village requiring electrical energy to operate a light or other electrically energized device, each of the electrically energized devices in the miniature houses or buildings having an electrical energy supply cord connected to the single electrical cord conveying direct current electrical energy from the transformer.

1 Claim, 4 Drawing Sheets

LIGHTING SYSTEM FOR DECORATIVE MINIATURE HOUSES AND VILLAGE DISPLAYS

BACKGROUND OF THE INVENTION

1. Field of the Invention

The invention relates to electrical lighting systems. In particular, the invention relates to electrical lighting systems for decorative miniature houses and village displays.

2. Description of the Related Art

Decorative displays of miniature houses and villages are common and widely utilized during the Christmas holiday season. When preparing such decorative miniature house and village displays, 110 volt alternating current (hereinafter V AC) available throughout the United States is frequently used to provide energy to energize the lights commonly utilized in the displays.

To energize 110 V AC lights in displays of miniature houses and villages with such common 110 V AC, each cord leading to a light in a house must be plugged into a female wall receptacle, or an electrical extension cord is plugged into a wall socket and extended to the electrical outlet cord from the miniature house containing the light or lights requiring 110 V AC. The cord from the miniature house requiring 110 V AC and other miniature houses or other structures requiring 110 V AC voltage are plugged into the extension cord until all outlets in the extension cord are full.

When displaying decorative miniature villages containing many miniature houses, churches, and other structures, many extension cords are needed to provide lighting, and the many bulky and unsightly cords detract from the aesthetic quality of the decorative display. Furthermore, concealment of the cords is difficult and adds further expense to the preparation of a decorative miniature village display.

Thus, there is a need for an electrical lighting system for decorative miniature houses and villages which eliminates the problems encountered with lighting such decorative miniature houses and villages with conventional electrical cord.

Exemplary of the related art are the following U.S. Pat. Nos. 3,664,055; 4,203,053; 4,462,066; and 5,248,276.

SUMMARY OF THE INVENTION

In accordance with the present invention there is provided a method and system for lighting decorative miniature houses and villages utilizing a transformer powered by 110 V AC and having a direct current output conveyed from the transformer through an electrical cord having a positive and a negative wire therein, the electrical cord being connected adjacent to each of the miniature houses or buildings in the village requiring electrical energy to operate a light or other electrically energized device, each of the electrically energized devices in the miniature houses or buildings having an electrical energy supply cord connected to the single electrical cord conveying direct current electrical energy from the transformer.

The present invention has the advantage of eliminating unsightly and bulky 110 V AC energy supply cords from decorative miniature houses and villages having electrically energized devices therein.

DESCRIPTION OF THE PREFERRED EMBODIMENTS

Figure 1:
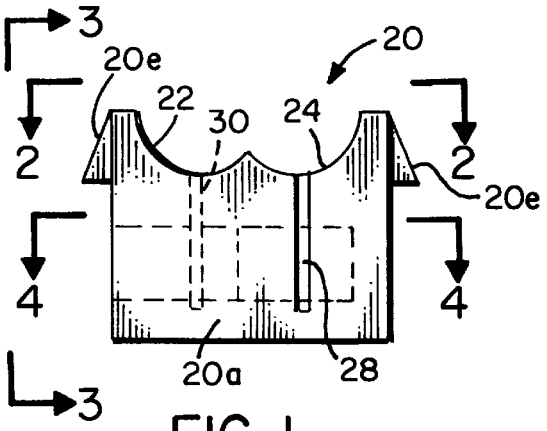
FIG. 1 is a front elevational view of the base of an electrical connector of the invention.
Figure 2:
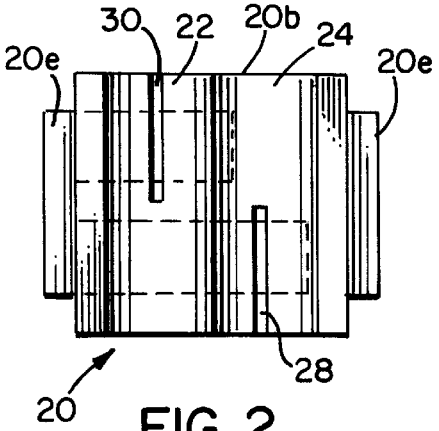
FIG. 2 is a top view of the electrical connector base of FIG. 1 taken along lines 2—2 of FIG. 1.
Figure 3:
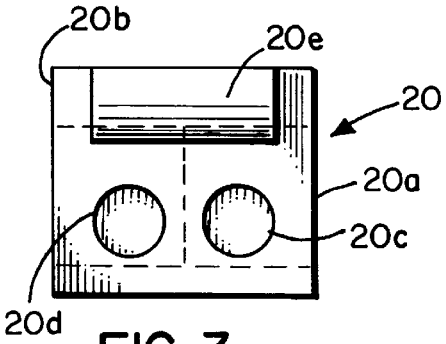
FIG. 3 is a side, elevational view of the electrical connector base of the invention shown in FIG. 1 taken along lines 3—3 of FIG. 1.
Figure 4:
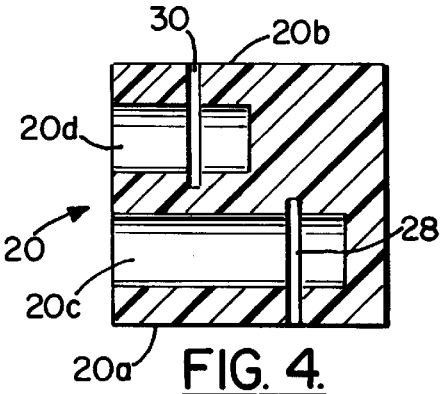
FIG. 4 is a cross-sectional view of the electrical connector base FIG. 1 taken along lines 4—4 of FIG. 1.

Referring now to the drawings, in FIG. 1 is shown the preferred electrical connector base generally indicated by the numeral 20 utilized with the lighting system of the present invention. Connector base 20 is preferably made from a conventional polymeric material which is electrically non-conductive.

Figure 9:
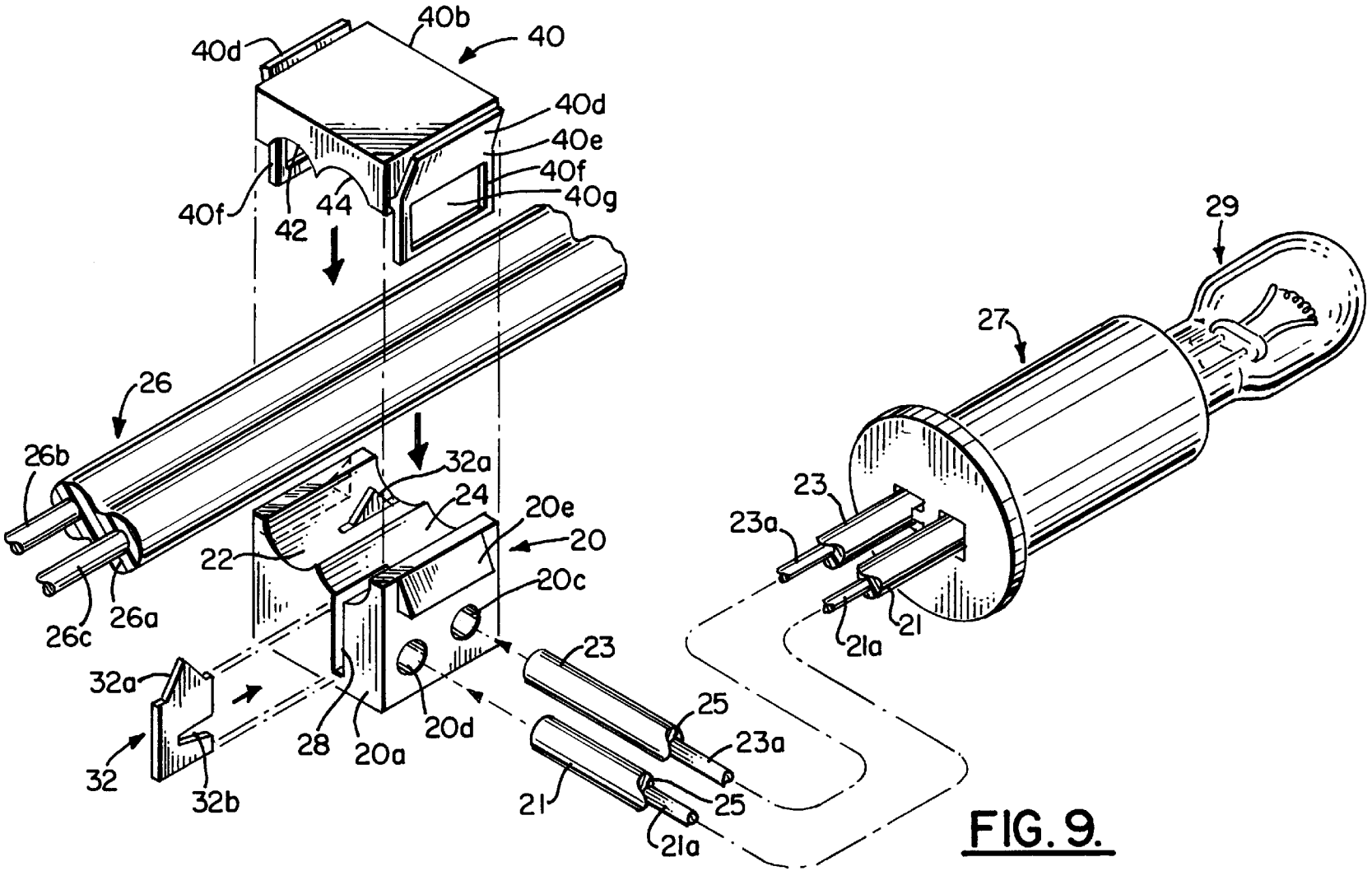
FIG. 9 is a schematic perspective view of the electrical connector assembly and the manner in which a wire and a light are electrically connected thereto.

Connector base 20 can be seen in FIGS. 1–4 and 9 to have a generally cubical shape with a pair of parallel semi-circular grooves 22 and 24 in the top side thereof for receipt of the electrical cord 26 as shown by the arrows in FIG. 9. Semi-circular grooves 22 and 24 extend between rectangular front face 20*a* of base 20 and rear face 20*b* of base 20.

Electrical cord 26 can be seen in FIG. 9 to be a conventional electrical cord well known in the art having electrical insulation 26*a* molded around two electrically conductive wires 26*b* and 26*c*. Electrical insulation 26*a* is preferably a polymeric material known in the art, and wires 26*b* and 26*c* are preferably a well known conductor such as copper or the like.

Figure 5:
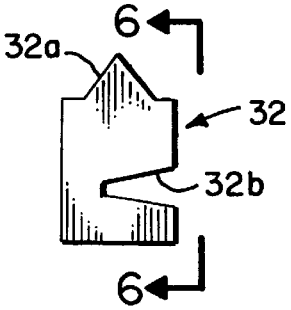
FIG. 5 is a front elevational view of a blade component of the electrical connector base shown in FIG. 1.
Figure 6:
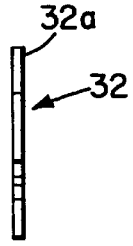
FIG. 6 is a side elevational view of the blade component the electrical connector base of FIG. 1 taken along lines 6—6 of FIG. 1.

Connector base 20 has two generally rectangular parallel slots 28 and 30 for receipt of blades 32—32 shown in FIGS. 5, 6, and 9. Slot 28 extends inwardly perpendicularly from front face 20*a* to the approximate center of connector base 20, and slot 30 extends inwardly perpendicularly from rear face 20*b* to the approximate center of connector base 20. Slot 28 is aligned parallel to the approximate center of groove 24 and communicates therewith. Slot 30 is aligned parallel to the approximate center of groove 22 and communicates therewith.

Connector base 20 has two parallel, spaced apart hollow cylindrical chambers 20*c* and 20*d* therein in the lower portion of connector base 20 beneath grooves 22 and 24. Chambers 20*c* and 20*d* are intersected and communicate with slots 28 and 30, respectively. Preferably hollow chambers 20*c* and 20*d* are aligned perpendicularly to the longitudinal axes of grooves 22 and 24. As shown in FIG. 9, chambers 20*c* and 20*d* receive wires 21 and 23 extending from the conventional light bulb socket generally indicated by the numeral 27 in FIG. 9 which contains a conventional light bulb generally indicated by the numeral 29 for lighting a miniature decorative building generally indicated by the numeral 31 in FIG. 10. Connector base 20 also has two tapered shoulders 20*e*—20*e* on opposite faces thereof which preferably have a generally triangular cross-section.

Blades 32—32 each have a point 32*a* which extends upwardly from the top of slots 28 and 30 as shown in FIG. 9. Point 32*a* preferably is generally triangular in shape and pierces insulation 26*a* of cord 26 to make electrical contact with wire 26*c* and conduct electrical current therefrom. Point 32*a* pierces insulation 26*a* when the connector cap generally indicated by the numeral 40, shown in FIGS. 7–9, is placed over cord 26, aligned over connector base 20, and forced downward into engagement with connector base 20 as indicated in FIG. 9.

Each blade 32 has a tapered or V-shaped slot 32*b* therein for engaging and piercing the electrical insulation 25 of wires 21 and 23 to make electrical contact with each of the electrical conductors 21*a* and 23*a*. Electrical insulation 26*a* is preferably a polymeric material known in the art, and electrically conductive wires 21*a* and 23*a* are each preferably well known conductors such as copper or the like.

Figure 7:
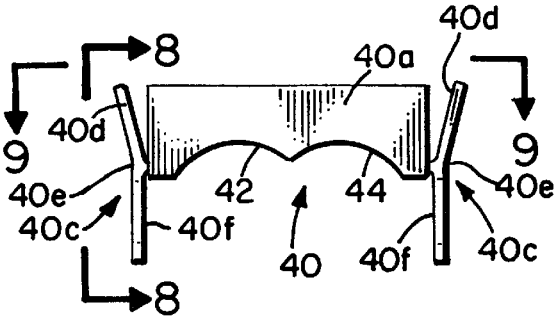
FIG. 7 is a front elevation view of a cap for connection to the electrical connector base of FIG. 1.
Figure 8:
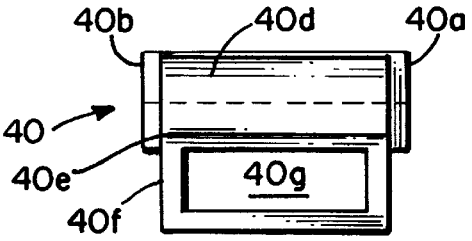
FIG. 8 is a side elevational view of the cap of FIG. 7 taken along lines 8—8 of FIG. 7.

Connector cap 40 can be seen in FIGS. 7–9 to have a generally cubical shape with a pair of parallel semi-circular grooves 42 and 44 in the bottom side thereof for receipt of the electrical cord 26 as shown by the arrows in FIG. 9. Semi-circular grooves 42 and 44 extend between rectangular front face 40*a* of connector cap 40 and rear face 40*b* of connector cap 40. As shown in FIG. 9, cord 26 is received in grooves 42 and 44 of connector cap 40.

Connector cap 40 has two clip assemblies 40*c*—40*c* on opposite faces thereof for selective engagement with tapered shoulders 20*e*—20*e* of connector base 20. Each clip assembly 40*c*—40*c* has a generally rectangular solid upper portion 40*d* connected to connector cap 40 at hinge 40*e*—40*e*. Hinge 40*e*—40*e* is connected to lower slotted portion 40*f*—40*f* having rectangular slot or opening 40*g* therein. As can be seen in FIG. 9, lower slotted portion 40*f* of clip assembly 40*c* can be aligned with and fitted over shoulder 20*e* of the connector base 20, shoulder 20*e* being fitted into slot or opening 40*g*. To aid in connecting or disconnecting connector cap 40 to connector base 20, upper solid portions 40*d*—40*d* can be pressed toward connector cap 40 to rotate clip assembly 40*c* about hinge 40*e* to thereby cause lower slotted portion 40*f* to move outwardly and over shoulder 20*e*. The assembled connecter base 20 and connector cap 40 results in connector assembly generally indicated by the numeral 50 in FIG. 9 and 11.

Figure 10:
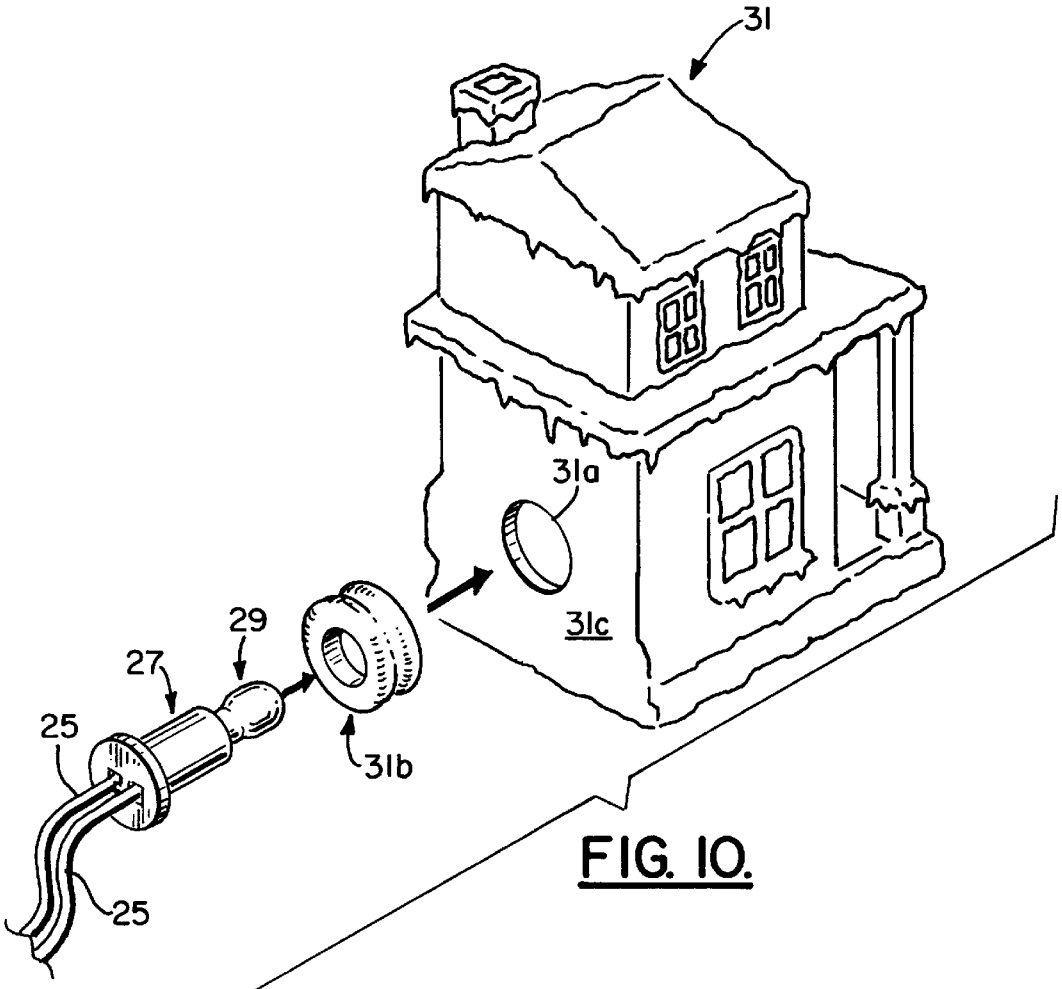
FIG. 10 is an exploded schematic perspective view of a miniature decorative house having a light aligned for connection thereto utilizing a grommet.
Figure 14:
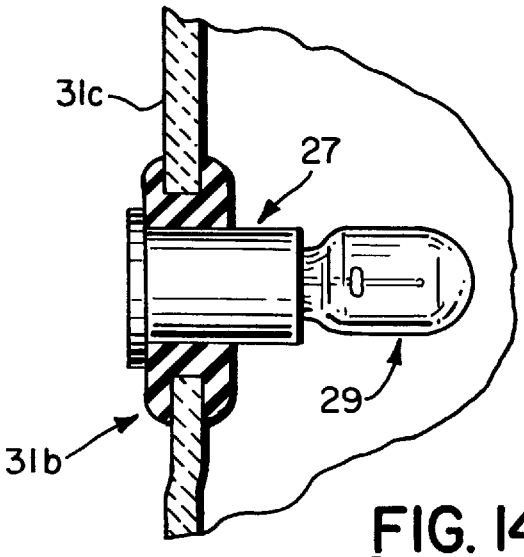
FIG. 14 is a partly cross-sectional, partly cut-away side elevational view of a light bulb socket fastened to a wall of a decorative miniature building by a grommet.

As can be seen in FIG. 10, a typical decorative miniature building or house 31 is provided with an opening or hole 31*a* in the wall 31*c* thereof for receipt of light bulb 29 and socket 27. Preferably a conventional grommet 31*b*, shown in FIG. 10 and 14, connects the socket 27 containing light bulb 29 to opening 31*a* in wall 31*c* of building 31. Grommet 31*b* is inserted into opening 31*a*, the light bulb 29 is inserted into the socket 27, and the socket 27 having light bulb 29 is inserted into the opening in the center of grommet 31*b*. The grommet 31*b* secures the socket 27 and protects the finish of the building 31. Building 31 could be any desired decorative miniature building such as a house, hotel, office building, barn, church, and the like. Furthermore, the present invention could be used to light other seasonal decorations or collectibles such as ceramic and porcelain houses, animals, buildings, Christmas trees or the like used during any holiday such as Christmas, Easter, Independence Day, or the like.

Figure 11:
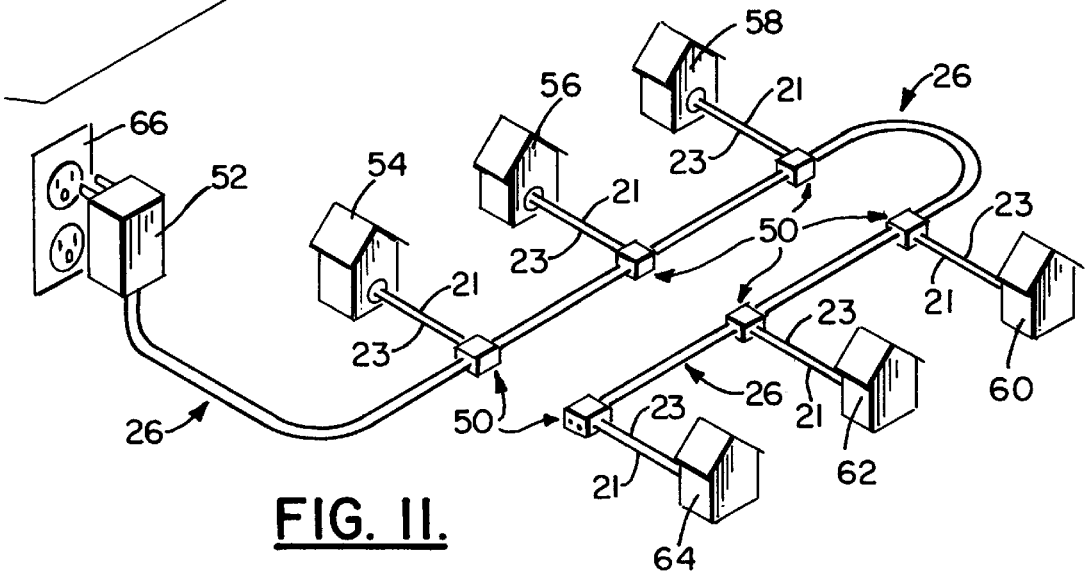
FIG. 11 is a perspective, schematic view of a plurality of miniature decorative houses connected to the lighting system of the invention.

As can be seen in FIG. 11, in accordance with the present invention there is provide a conventional transformer 52 for converting AC current from wall socket 66 to direct current conveyed by cord 26 to lights contained inside a plurality of decorative miniature buildings 54, 56, 58, 60, 62, and 64. Each of the miniature buildings have wires 21 and 23 for conveying electrical energy to lights or other electrical devices which are connected to wire 25 by connector assembly 50. Preferably wires 21 and 23 have electrically conductive wires 21*a* and 23*a* of 18 gauge copper, and the light 29 at the ends of wires 21 and 23 is about 4 watts.

As shown in FIG. 11, transformer 52 is connected to a conventional wall outlet 66 which provides 110 V AC. Transformer 52 is preferably 40, 80, or 120 watts, although other transformer may be used. The direct current provided by transformer 52 is preferably 12 volts, and the electrical conductive wires 26*b* and 26*c* in cord 26 are about 16 gauge copper.

Figure 12:
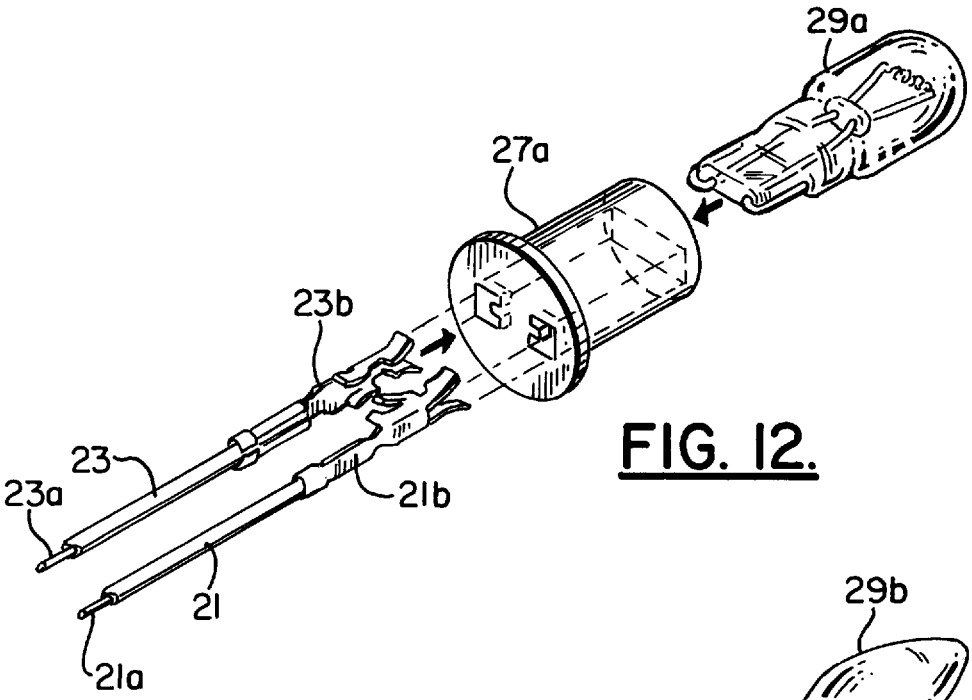
FIG. 12 is a perspective, exploded view of a light, light socket, and wiring connection utilized with the present invention to light a miniature decorative house or other building.

As shown in FIG. 12, if desired, flat base or wedge style light bulb 29*a* could be used to light miniature decorative structures such as house 31. Socket 27*a* would receive clamps 21*b* and 23*b* in alignment with the base of light bulb 29 and in electrical contact therewith.

Figure 13:
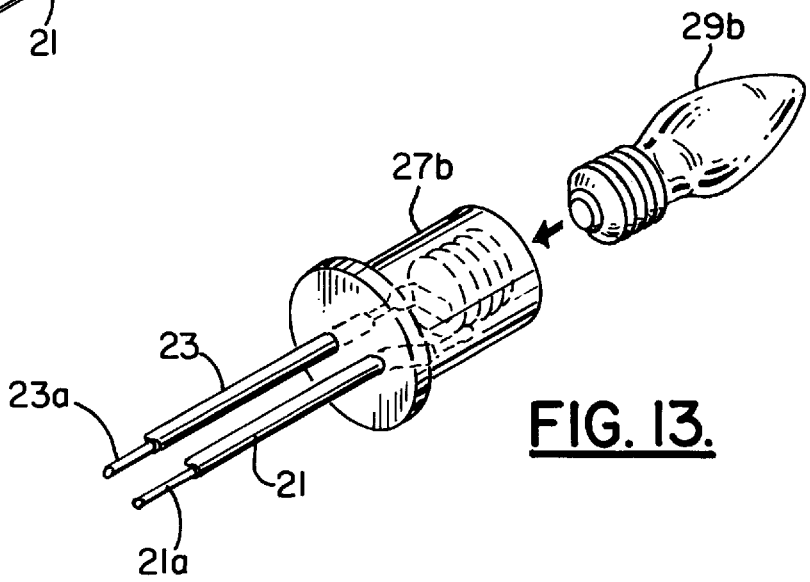
FIG. 13 is a perspective, exploded view of an alternate light, light socket, and wiring connection utilized with the present invention.

As shown in FIG. 13, if desired, threaded round base light bulb 29*b* could be used to light miniature decorative structures such as house 31. Socket 27*b* would receive wires 21 and 23 and light bulb 29*b* in the other end thereof in the threaded open end thereof.

Although the preferred embodiments of the invention have been described in detail above, it should be understood that the invention is in no sense limited thereby, and its scope is to be determined by that of the following claims:

What is claimed is:

1. A lighting system for lighting decorative miniature houses, buildings and villages comprising:

a. a transformer for converting alternating electrical current into direct electrical current, b. a source of alternating current connected to said transformer, c. a power cord extending from said transformer for conveying direct electrical current from said transformer, said power cord having two separate electrically conductive flexible wires therein, d. a plurality of decorative miniature houses and buildings having lights therein, each of the lights in said decorative miniature houses or buildings having two electrically conductive wires connected thereto, and e. a connector assembly connectable to said power cord at any desired location on said power cord for electrically connecting said lights in said houses and buildings to said power cord, said connector assembly including:

i. a connector base having top, bottom and sides therebetween, said connector base having a device therein for partial receipt of said power cord and said connector base having a device for receiving said two electrically conductive wires and supplying electrical energy thereto, said connector base having grooves therein for receipt of said power cord, said connector base having a slot formed at one of said sides adjacent to each of said grooves, a blade being fitted into each of said slots having a single point therein to penetrate said power cord and make electrical contact with said power cord, said blade having a V-shaped slot therein which engages and pierces electrical insulation on said wires extending from said light to make electrical contact with said wires, said device for receiving wires being located adjacent to said grooves, said connector base having shoulders ii. a connector cap having clips connectable to said shoulders of said connector base, said connector cap being adapted to force said power cord into electrical contact with said connector base when said connector cap is connected to said connector base, said connector cap having grooves therein for receipt of said power cord.

* * * * *